US005172446A

United States Patent [19]

Schulein

[11] Patent Number: 5,172,446

[45] Date of Patent: Dec. 22, 1992

[54] MOP AND MOP-SQUEEZE COMBINATION

[75] Inventor: Rolf-Gunter Schulein, Singhofen, Fed. Rep. of Germany

[73] Assignee: Leifheit AG, Nassau/Lahn, Fed. Rep. of Germany

[21] Appl. No.: 704,132

[22] Filed: May 22, 1991

[30] Foreign Application Priority Data

May 22, 1990 [EP] European Pat. Off. ..... 90109750.1

[51] Int. Cl.[5] ..... A47L 13/20

[52] U.S. Cl. ..... 15/119.1; 15/116.1; 15/262

[58] Field of Search ..... 15/116.1, 116.2, 119 R, 15/119 A, 261

[56] References Cited

U.S. PATENT DOCUMENTS

| | | | |
|---|---|---|---|
| 2,028,025 | 1/1936 | Smith | 15/119 R |
| 2,235,264 | 3/1941 | Rogers | 15/119 A |
| 2,521,445 | 9/1950 | Brown | 15/119 R |
| 2,729,840 | 1/1956 | Rogers | 15/119 A |
| 3,233,269 | 2/1966 | Schefford | 15/119 A |
| 3,946,457 | 3/1976 | Robinson . | |
| 4,557,012 | 12/1985 | Knebel et al. . | |
| 4,610,044 | 9/1986 | Schulein . | |
| 4,654,920 | 4/1987 | O'Neil et al. | 15/119 A |
| 4,809,387 | 3/1989 | Nakamura et al. . | |
| 5,060,338 | 10/1991 | Yates et al. | 15/119 A |

FOREIGN PATENT DOCUMENTS

| | | | |
|---|---|---|---|
| 0128225 | 3/1987 | European Pat. Off. . | |
| 0156929 | 3/1987 | European Pat. Off. . | |
| 2455638 | 10/1982 | Fed. Rep. of Germany . | |
| 2264511 | 10/1975 | France . | |
| 0593452 | 10/1947 | United Kingdom | 15/116.1 |
| 1128520 | 9/1968 | United Kingdom . | |
| 1586313 | 3/1981 | United Kingdom | 15/119 R |
| 2206038 | 12/1988 | United Kingdom . | |

*Primary Examiner*—Harvey C. Hornsby
*Assistant Examiner*—James F. Hook
*Attorney, Agent, or Firm*—Frishauf, Holtz, Goodman & Woodward

[57] ABSTRACT

A mop and mop-squeeze combination has a handle (1), a mop head (4) and a wringer device (3) disposed behind the mop head (4), the wringer device comprising a box-like sheath (14), a squeeze roller (23) supported in oblique guides (22) and traveling from the outside inward, and opposed guide rollers (20). The wet mop cloth is wrung out by being pulled into the sheath.

18 Claims, 2 Drawing Sheets

MOP AND MOP-SQUEEZE COMBINATION

This invention relates to a mop and mop-squeeze combination having a handle, a mop head with a mop cloth, and a wringer device disposed behind the mop head, wherein the mop cloth is detachably secured to a pulling device that can be pulled into and through the wringer device from both lateral ends of the mop head via a pulling handle, in guide tracks, which pulling device guides the mop cloth from a wide-area cleaning position to a pressing position into the wringer device wherein the mop cloth is squeezed or wrung out to remove liquid therefrom.

BACKGROUND OF THE INVENTION

Mops in which provision is made to prevent a user,s hands from being constantly in contact with the dirty water are widely used for wet mopping.

One such device is described in European Patent Application No. 01 28 225, the entire contents of which are incorporated herein by reference. In this mop, a damp or wet mopping cloth is pulled over guides into a pressing device and is wrung out via a second actuating lever in the pressing device. This mop is highly technical, complicated in design, relatively heavy, and difficult to manipulate because of the necessity of actuating two levers or handle elements.

The object of the present invention is to provide a mop in which actuating of the mop is done with a light-weight actuating element that is simple to mount during manufacture, and which is easy to use.

SUMMARY OF THE INVENTION

According to the present invention, a mop and mop-squeeze combination comprises a handle (1); a pulling handle (2) slideably coupled to said handle (1); a mop head (4) with a mop cloth (5), said mop head (4) having two lateral end portions (8); a wringer device (3) disposed behind the mop head (4); and a pulling device (6) to which the mop cloth (5) is detachably secured. The pulling device (6) comprises guide tracks (7) extending from the lateral end portions (8) of said mop head (4) to said wringer device (3), said pulling device (6) being coupled to said pulling handle (2) and being arranged at least partially in said mop head (4) and at least partially along said wringer device (3), such that said mop cloth (5) is pulled into and through said wringer device (3) from both lateral end portions (8) of said mop head (4) responsive to pulling upwardly of said pulling handle (2), via said guide tracks, said pulling device (6) thereby guiding said mop cloth (5) from a wide-area cleaning position to a pressing or squeezing position into said wringer device (3). The wringer device (3) comprises a housing member (14) which is connected to said handle (1); said housing member (14) having an inlet region (15) on both sides of said guide tracks (7); at least two sets of guide rollers (20), each set of guide rollers (20) being arranged at respective sides of said guide tracks (7); and a squeeze roller (23) supported in oblique elongated guides (22) extending from an outer portion of said housing toward an inner portion of said housing and along which said squeeze roller is movable from a rest position to a wringing position closer to said guide rollers (20) to squeeze said mop cloth between said squeeze roller (23) and said guide rollers (20) in said wringing position.

The particular arrangement of the present invention results in a particularly compact, light-weight device easy to operate, and easy to manufacture.

DETAILED DESCRIPTION

Figure 1:
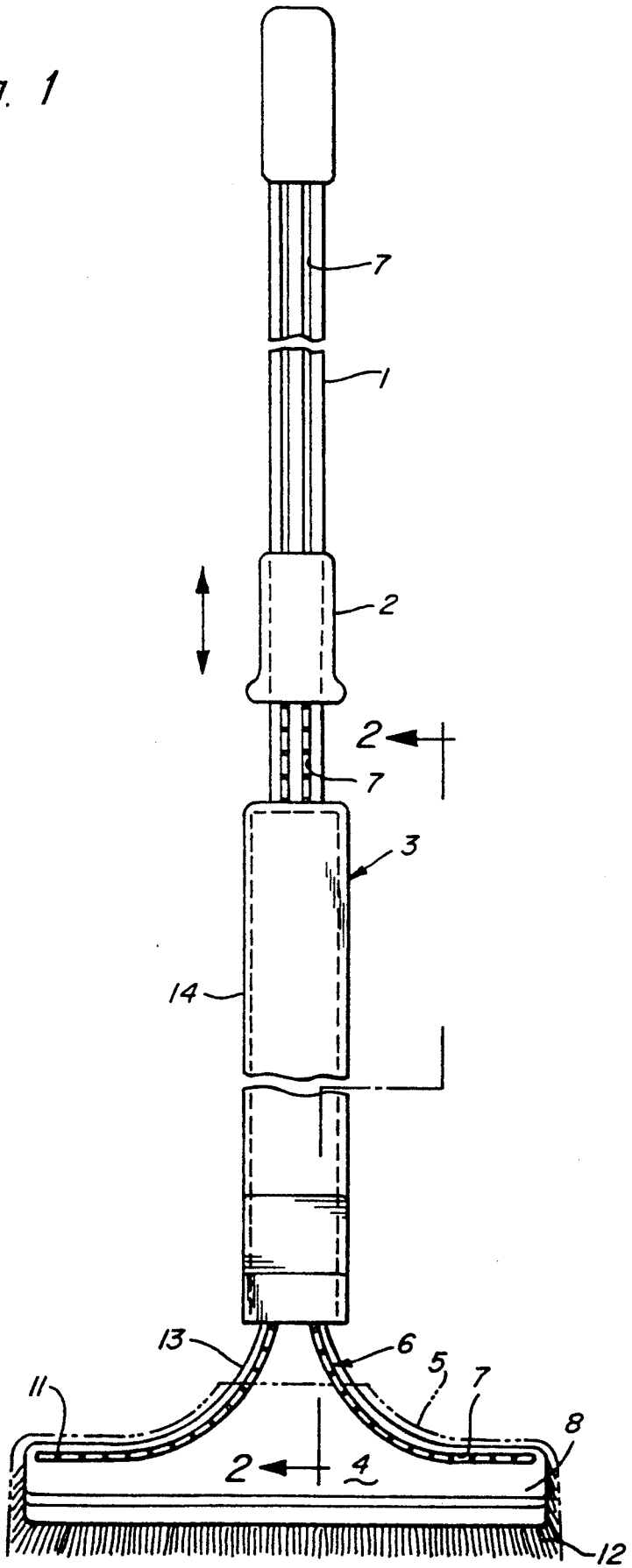
FIG. 1 is a plan view, partially in section, of a mop of the present invention.
Figure 3:
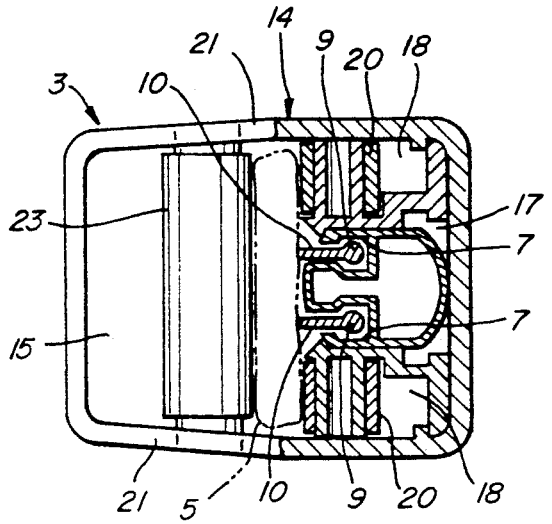
FIG. 3 is a section taken along the line 3—3 in FIG. 2.
Figure 2:
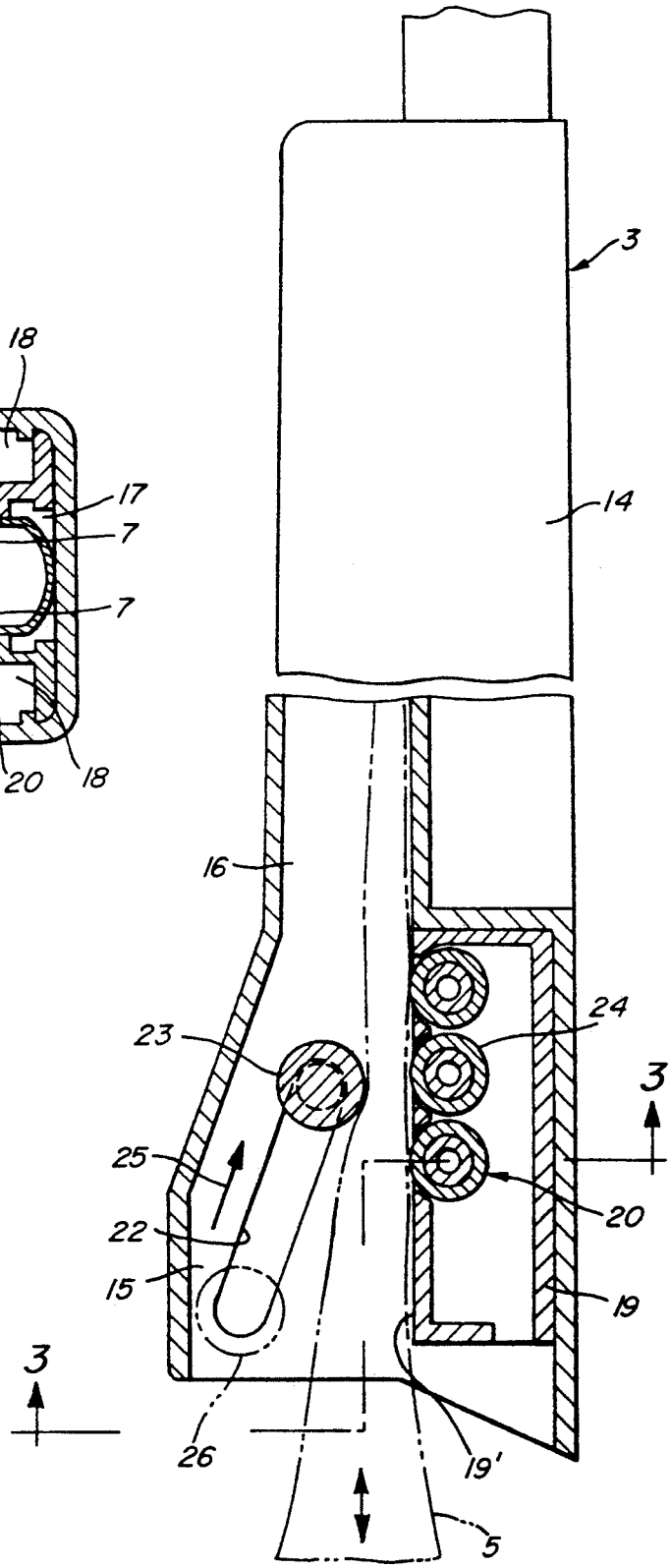
FIG. 2 is a section taken along the line 2—2 in FIG. 1.

Referring to FIGS. 1-3, a mop of the present invention comprises an elongated mop handle 1, a pull handle 2 slidably mounted on the mop handle 1, a wringer device 3 mounted on the handle 1, a mop head 4 with a mop cloth 5 (shown by dot-dash lines in the drawings), and a pulling device 6. The pulling device 6 comprises an elongated member having two elongated, curved, grooves 7 of T-shaped cross section (see FIG. 3), which pass into and through the wringer device 3 in the mop head 4 in curved fashion from the lateral ends 8 of the mop head 4, and which grooves 7 are continued in the mop handle 1. The grooves 7 serve as elongated guide tracks. The pulling device 6 also includes bars 9 slidably guided in grooves 7 and a pulling handle 2 connected to the bars 9 (by means not shown) to pull bars 9 along the grooves 7. In the region of the mop head 4, fastening cams or members 10 for the mop cloth 5 are connected to the bars 9 (i.e., members I0 are removably connected to, or are formed integral with, the bars 9). The bars 9 are provided with notches 11 to which are attached members 10. The members 10 are connected at their other ends to the mop cloth 5.

The mop cloth 5 is detachably mounted in the pulling device 6 for easy replacement thereof, for example by connecting a new mop cloth and its associated members 10 to rods 9 in the grooves 7 of pulling device 6.

The mop head 4 is provided with bristles 12 in the manner of a scrubber, on the side thereof remote from the mop cloth 5. It is also possible, and for certain applications practical, to replace the bristles 12 with an elastic or foam-type plate-like or slab-like member.

The wringer device 3 begins at the transition region 1 between the widened mop head 4 and the elongated handle 1. The wringer device 3 comprises a box-like sheath or housing 14 with an inlet region 15 (see FIG. 2) and a mop cloth chamber 16 of reduced height, as well as a mop handle channel 17 (see FIG. 3) formed onto it and a pair of roller carrier channels 18 formed therein. The roller carrier channels 18 are provided at the inlet region 15 on both sides of the guide tracks 7. The mop handle 1 passes through channel 17 so as to connect to the housing 14. One roller carrier 19 (FIG. 2) with three guide rollers 20 mounted therein is mounted in each roller carrier channel 18 (see FIG. 3). The roller carriers 19 are insertable into the housing 14 from the bottom open end 15 of housing 14 for easy assembly during manufacture, and are secured in position, for example by an adhesive or other suitable means. Inclined guides 22 in the form of oblique, oblong (elongated) slots, in which a squeeze roller 23 is displaceably supported, are provided in the opposite side walls 21 of the wringer sheath or housing 14. These inclined elongated roller guides 22 are located beginning at the inlet region 15 of the wringer 3 and ending approximately above the middle rollers 24 of the two sets of guide rollers 20.

The mop cloth chamber 16 is reduced in height (in the horizontal direction in FIG. 2), in the area behind (i.e. above in FIG. 2) the guide rollers 20, by about one-third as compared to the height of inlet portion 15.

The mop is shown in the mopping position in FIG. 1. The mop cloth 5 is represented by dot-dash lines. After water is picked up from the surface to be cleaned by the mop cloth 5, the mop cloth 5 is pulled into the wringer 3 by means of pulling upwardly the pull handle 2, which is supported axially displaceably on the mop handle 1. Pulling up on pull handle 2 pulls the bars 9 up. In this process, the fastening cams or members 10 travel upward and inward along the flared out bottom end of pulling device 6 by virtue of the bars 9 moving along grooves 7, and thus automatically fold the mop cloth 5 to the reduced width of the sheath or housing 14. As the mop cloth 5 is drawn further upwardly by pulling pull handle 2, the mop cloth 5 is drawn into the mop cloth chamber 16 (FIG. 2), the squeeze roller 23 travels out of the "rest" position shown in dot-dashed lines in the direction of the arrow 25 into the final or wringing position shown by solid lines in FIG. 2, above the middle ones 24 of the sets of three guide rollers. The mop cloth 5 is squeezed out by being drawn in further, between the squeeze roller 23 (in its wringing position) and the guide rollers 20, by continued pulling up of the pull handle 2, and the water is wrung or squeezed out. The guide rollers 20, which protrude slightly outwardly beyond the surface 19' of the roller carrier 19, allow the mop cloth 5 to slide easily into and along the mop cloth chamber 16 while being wrung or squeezed out between rollers 23 and guide rollers 20.

As the mop cloth is expelled downwardly, by pushing downwardly the pull handle 2, after having been wrung out by being pressed between the rollers, the squeeze roller 23 travels back to the rest position 26 thereof, shown in dot-dashed lines in FIG. 2.

By combining the guide rollers 20 on both sides with the squeeze roller 23, the exertion of force when the mop cloth 5 is pulled upwardly into the wringer device 3 and thus when it is wrung out, is kept low, and there is little wear and tear on the mop cloth 5. By contrast, it has been found that an arrangement of two squeeze rollers that converge in a V, as shown in German Patent Disclosure Document 24 55 637 (the entire contents of which are incorporated herein by reference) causes jamming, and strains the mop cloth to such an extent that it wears out prematurely.

Providing three guide rollers 20 at each side is an optimal compromise between the exertion of force and the wringing effect. By providing the guide rollers on a roller carrier, simple assembly becomes possible. The particular embodiment of the mop chamber 14 in cooperation with the roller carrier channel 18 and the channel 17 for the mop handle results in a particularly compact, light-weight device which is easy to assemble.

While the invention has been described above with respect to specific embodiments, various modifications and alterations can be made within the spirit and scope of the appended claims.

What is claimed is:

1. A mop and mop-squeeze combination, comprising:

a handle (1);

a pulling handle (2) slideably coupled to said handle (1);

a mop head (4) with a mop cloth (5), said mop head (4) having two lateral end portions (8);

a wringer device (3) disposed behind the mop head (4); and a pulling device (6) to which said mop cloth (5) is detachably secured, said pulling device (6) comprising guide tracks (7) extending from said lateral end portions (8) of said mop head (4) to said wringer device (3), said pulling device (6) being coupled to said pulling handle (2) and being arranged at least partially in said mop head (4) and at least partially along said wringer device (3), such that said mop cloth (5) is pulled into and through said wringer device (3) from both lateral end portions (8) of said mop head (4) responsive to pulling upwardly of said pulling handle (2), via said guide tracks, said pulling device (6) thereby guiding said mop cloth 95) from a wide-area cleaning position to a pressing or squeezing position into said wringer device (3);

said wringer device (3) comprising:

a housing member (14) which is connected to said handle (1);

said housing member (14) having an inlet region for receiving said guide tracks (7) therethrough;

at least two sets of guide rollers (20), each set of guide rollers (20) being arranged at a respective side of said guide tracks (7);

and a squeeze roller (23) supported in oblique elongated guides (22) extending from an outer portion of said housing toward an inner portion of said housing and along which said squeeze roller is movable from a rest position to a wringing position closer to said guide rollers (20) to squeeze said mop cloth between said squeeze roller (23) and said guide rollers (20) in said wringing position.

2. The mop and mop-squeeze combination of claim 1, further comprising at least two roller carriers (19) in said housing (14), said sets of guide rollers (20) being supported on respective ones of said roller carriers (19).

3. The mop and mop-squeeze combination of claim 2, wherein said roller carriers (19) with said guide rollers are insertable as a unit from a lower open end (15) of said housing (14).

4. The mop and mop-squeeze combination of claim 2, wherein said roller carriers (19) each carry three guide rollers (20); and wherein said squeeze roller (23), in the wringing position, is located approximately above a middle (24) one of said three guide rollers (20).

5. The mop and mop-squeeze combination of claim 1, wherein said housing (14) comprises:

a mop cloth chamber (16); and a handle receiving channel (17) and at least one guide roller carrier receiving channel (18) formed in said mop cloth chamber (16).

6. The mop and mop-squeeze combination of claim 5, wherein said mop cloth chamber (16) is reduced in height behind said guide rollers (20).

7. The mop and mop-squeeze combination of claim 6, wherein said mop cloth chamber (16) is reduced in height by about one-third behind said guide rollers (20).

8. The mop and mop-squeeze combination of claim 5, wherein said handle receiving channel (17) is behind said at least one guide roller carrier receiving channel (18), and is approximately shaped to the contour of said handle (1) to receive said handle (1) therein.

9. The mop and mop-squeeze combination of claim 2, wherein said housing (14) comprises:

a mop cloth chamber (16); and a handle receiving channel (17) and at least one guide roller carrier receiving channel (18) formed in said mop cloth chamber (16).

10. The mop and mop-squeeze combination of claim 9, wherein said mop cloth chamber (16) is reduced in height behind said guide rollers (20).

11. The mop and mop-squeeze combination of claim 10, wherein said mop cloth chamber (16) is reduced in height by about one-third behind said guide rollers (20).

12. The mop and mop-squeeze combination of claim 9, wherein said handle receiving channel (17) is behind said at least one guide roller carrier receiving channel (18), and is approximately shaped to the contour of said handle (1) to receive said handle (1) therein.

13. The mop and mop-squeeze combination of claim 4, wherein said housing (14) comprises:

a mop cloth chamber (16); and a handle receiving channel (17) and at least one guide roller carrier receiving channel (18) formed in said mop cloth chamber (16).

14. The mop and mop-squeeze combination of claim 13, wherein said mop cloth chamber (16) is reduced in height behind said guide rollers (20).

15. The mop and mop-squeeze combination of claim 14, wherein said mop cloth chamber (16) is reduced in height by about one-third behind said guide rollers (20).

16. The mop and mop-squeeze combination of claim 13, wherein said handle receiving channel (17) is behind said at least one guide roller carrier receiving channel (18), and is approximately shaped to the contour of said handle (1) to receive said handle (1) therein.

17. The mop and squeeze combination of claim 1, wherein:

said pulling device (6) comprises an elongated member having a pair of elongated grooves (7) therein, said grooves comprising said guide tracks; and slide means (9) in said grooves (7) which are slideable along said grooves responsive to pulling of said pulling handle (2); and said mop cloth comprises connecting means (10) coupling said mop cloth to said slide means (9) for pulling said mop cloth along said grooves (7) responsive to said pulling of said pulling handle (2).

18. The mop and squeeze combination of claim 17, wherein said elongated member having said grooves (7) formed therein extends from said mop head, along said handle (1), and to above said wringer device (3).

* * * * *